US009901773B2

(12) United States Patent
Lee

(10) Patent No.: US 9,901,773 B2
(45) Date of Patent: Feb. 27, 2018

(54) SCAFFOLD FOR A FITNESS STEPPER

(71) Applicant: Cha-Young Lee, Chungcheongnam-do (KR)

(72) Inventor: Cha-Young Lee, Chungcheongnam-do (KR)

( * ) Notice: Subject to any disclaimer, the term of this patent is extended or adjusted under 35 U.S.C. 154(b) by 0 days.

(21) Appl. No.: 15/415,868

(22) Filed: Jan. 26, 2017

(65) Prior Publication Data

US 2017/0136292 A1 May 18, 2017

Related U.S. Application Data

(63) Continuation of application No. PCT/KR2015/002546, filed on Mar. 17, 2015.

(30) Foreign Application Priority Data

Jul. 31, 2014 (KR) ..... 10-2014-0098287

(51) Int. Cl.
*A63B 22/04* (2006.01)
*A63B 23/04* (2006.01)

(52) U.S. Cl.
CPC ..... *A63B 22/04* (2013.01); *A63B 23/0405* (2013.01)

(58) Field of Classification Search
CPC ..... A63B 22/0048; A63B 22/0056–22/0058; A63B 21/4035; B60N 3/044; F16B 15/0023–15/003; F16B 15/0046
See application file for complete search history.

(56) References Cited

U.S. PATENT DOCUMENTS 5,411,454 A * 5/1995 Chang ..... A61H 7/00 482/148
5,480,365 A * 1/1996 Lundin ..... A63B 22/0056 482/53

FOREIGN PATENT DOCUMENTS

| | | | |
|---|---|---|---|
| KR | 20-0357168 | Y1 | 7/2004 |
| KR | 20-0408778 | Y1 | 2/2006 |
| KR | 10-0720391 | B1 | 5/2007 |
| KR | 10-0853610 | B1 | 8/2008 |
| KR | 20-2009-0011953 | U | 11/2009 |
| KR | 10-2013-0107600 | A | 10/2013 |

OTHER PUBLICATIONS

International Search Report dated Jun. 17, 2015 for PCT/KR2015/002546, citing the above reference(s).

* cited by examiner

*Primary Examiner* — Loan H Thanh
*Assistant Examiner* — Jennifer M Deichl
(74) *Attorney, Agent, or Firm* — Hauptman Ham, LLP

(57) ABSTRACT

A scaffold for a fitness stepper comprises a scaffolding plate configured to be installed on the fitness stepper and a mat attached on upper side of the scaffolding plate. The scaffolding plate comprises a separating prevention frame extended from edge of the scaffolding plate and surrounding the mat attached on the upper side of the scaffolding plate and a plurality of protrusions form on the upper side of the scaffolding plate. The mat comprises a plurality of bumps formed on an upper side of the mat, and a plurality of grooves between adjacent bumps of the plurality of bumps. The plurality of protrusion is arranged to form a grid pattern on the upper side of the scaffolding plate. Each protrusion of the plurality of protrusions has a right triangle shape having a right angle and a tilt angle with the upper side of the scaffolding plate.

2 Claims, 6 Drawing Sheets

SCAFFOLD FOR A FITNESS STEPPER

CROSS-REFERENCE TO RELATED APPLICATIONS

The present application is a continuation of International Patent Application No. PCT/KR2015/002546, filed on Mar. 17, 2015, which is based upon and claims the benefit of priority to Korea Patent Application No. 10-2014-0098287, filed on Jul. 31, 2014. The disclosures of the above-listed applications are hereby incorporated by reference herein in their entirety.

TECHNICAL FIELD

The present invention is the Stepper which people can exercise like going up and down the stairs. To put it more concretely, we improved the scaffolding structure of the Stepper in order to help users feel soft. Also this Stepper can make users exercise without putting on sneakers indoors, even it can protect users' joints, waists, and ankles, moreover can make him or her get acupressure effects as well as the recovery from fatigue at the same time.

RELATED ART

Generally, the stepper is the fitness equipment practicing aerobic exercise and muscle exercise of the lower body. This Stepper is equipped with the left and right scaffoldings connected by the axis of rotation ahead of the frame, and the substructure. The above scaffolding is composed of the structures setting up oil pressure and air pressure cylinders, which give exercise effects to users generating repulsion sports activity when users apply pressure to the scaffoldings. The user of this Stepper stands on the left and right scaffoldings, and do repetitive exercise steps on this scaffolding in turn just like going up and down the stairs. Because this Stepper's scaffoldings especially generate the repulsive activity power by using the lower cylinder, the user steps the scaffoldings so strongly that it makes exercise effects maximization. Thus the Stepper that allows users to exercise by moving their both legs upward and downward like users walk while keeping standing on the left and right scaffoldings and applying force on them. The patent documents of this Stepper's details were posted on the Domestic Publicized Utility Model No. 20-2009-0011953 and the Domestic Registered Utility Model No. 20-0408778.

On the other hand, there were a lot of problems on the existing stepper scaffoldings. Because they were made of firm synthetic resins just like PVC, they felt very hard structurally and users had to put on their running shoes and exercise even indoors every time stepping the scaffoldings. Even though users put on running shoes not to feel uncomfortable, their brains' stimulation in relation to long-time exercise made users feel tired. In addition, the excessively hard scaffoldings brought about users' joints, waists and ankles Like this, the existing scaffoldings did not have the acupressure effects such as exercising with bare feet since users put on running shoes.

Therefore, these existing stepper scaffoldings had many problems.

DETAILED DESCRIPTION

Technical Tasks

Figure 1:
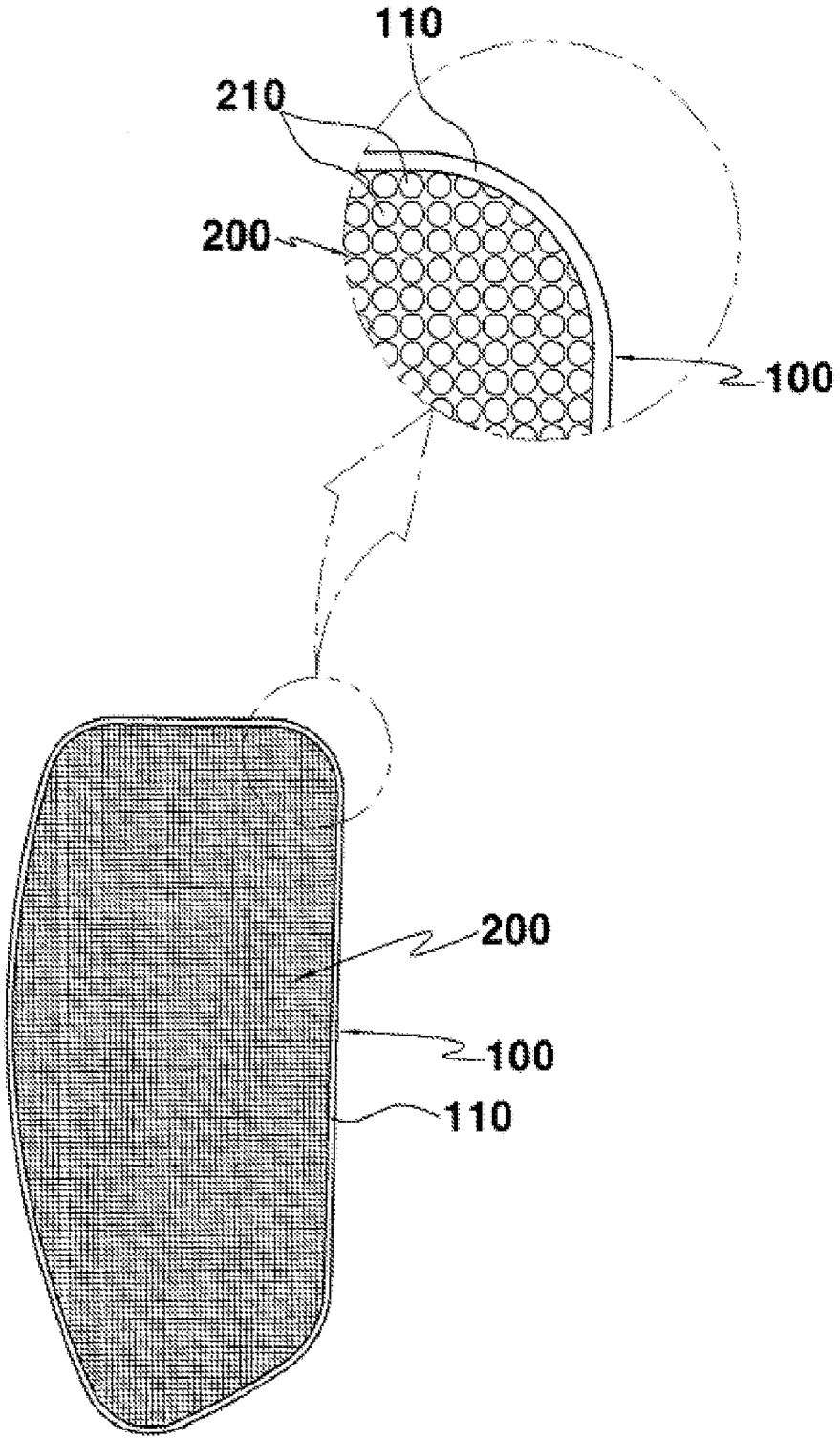
FIG. 1 is the ground plan of the presence invention.
Figure 2:
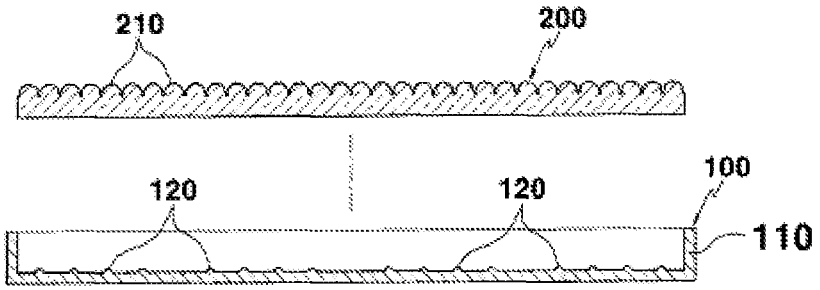
FIG. 2 is the cross-sectional diagram which shows the separation situation of the invention.
Figure 3:
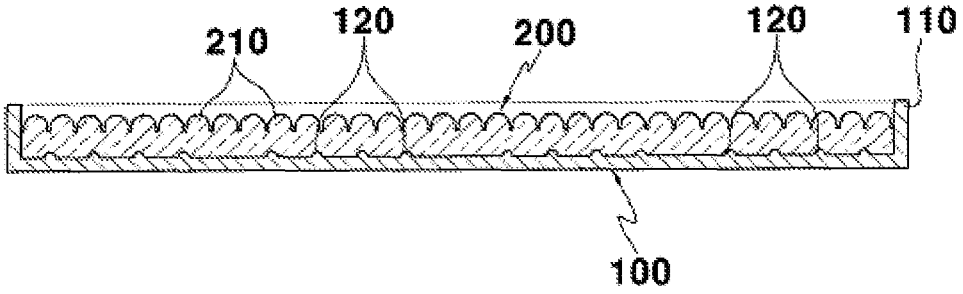
FIG. 3 is the cross-sectional diagram which shows the combination situation of the invention.

As mentioned above, the purpose of the present invention is to get rid of the existing products' faults and structures which make users move their both legs upward and downward like users walk while keeping standing on the both very firm scaffoldings and applying force on them in turn. So we invented the stepper scaffoldings putting mats, and our inventions are based on giving our users the most comfortable touch.

Also, our inventions help our users to be able to exercise without putting on sneakers, and to be able to step these mats softly with bare feet.

Moreover, thanks to the scaffoldings with mats, our inventions can protect users' joints, waists, and ankles and get users to be able to get acupressure effects as well as the recovery from fatigue at the same time.

The Methods of Tasks solutions

First, to accomplish the above purpose, we attached the soft mats on the scaffoldings where the feet are reached. Therefore, users can exercise without wearing sneakers even indoors, and with stepping mats which feel soft comfortably in their bare feet.

Second, on the upper edges of the above scaffoldings, the supporting frames for separating prevention covering the outside of the mats are made all-in-one system in order that the mats are not separated from the scaffoldings when the scaffoldings are tilted.

Third, these mats which are attached on the upper scaffoldings are made of elastic bodies mixed with rubber and silicon at 5 to 5 ratio. Thus, the mats are sunken when they are pressurized, and they are slowly restored after pressurizing.

Forth, these scaffoldings' mats are made of very soft silicon just like the silicon used in the operating silicon breast implants, so the mats are slowly restored.

Fifth, the upper side of the mats are arranged in many bumps which give air elasticity when they are pressurized.

Last, the upper side of the scaffoldings form a number of protrusions in a grid pattern. These frames prevent the upper mats from separating on the scaffoldings even though the scaffoldings are tilted at an angle of 45 degrees.

The Effects of the Invention

According to the stepper scaffoldings attaching mats, users can exercise with bare feet comfortably, not wearing sneakers indoors thanks to the scaffoldings with soft mats.

When users exercise with bare feet on the soft mats, they can obtain effects like walking on the moist and soft red clay tracks.

Even if users exercise with bare feet for a long time, those who exercise on the scaffoldings with mats can protect their joints, waists, and ankles as well as can obtain the recovery from fatigue and acupressure effects Because the mats on the scaffoldings do not get users' feet and brains to feel tired, and do not give them stimuli.

In addition, when users exercise on the scaffoldings, they can get effect such as the recovery from fatigue while swimming in the pool.

*The Explanation Of The Signs*

10: Stepper

100: Scaffoldings

110: The supporting Frames

120: The protrusions

200: The mats/210: the bumps

The Shape of the invention's accomplishment

The following is the invention's technical composition according as the attached drawings.

The stepper scaffoldings attaching mats of this invention is shown schematically from FIG. 1 to FIG. 7. As you can see this invention is the stepper (10) scaffoldings (100) where the feet are reached. This invention has a fundamental feature; attaching the soft mats (200) on the upper scaffoldings (100) makes users be able to exercise indoors without putting on sneakers, stepping the mats (200) softly with bare feet.

As is generally known, the principal of this stepper (10) is that users exercise, while standing on the left and right scaffoldings (100) and stepping on the both scaffoldings (100) in turn just like going up and down the stairs. This stepper (10) is equipped with the left and right scaffoldings (100) connected by the axis of rotation in front, The lower portions of the scaffoldings (100) is composed of the structures setting up oil pressure and air pressure cylinders, which give exercise effects to users generating repulsion sports activity when users apply pressure to the scaffoldings (100). At this time, the stepper (10) is equipped with the instrument panel (11) and two wires for hand exercises (12).

Figure 7:
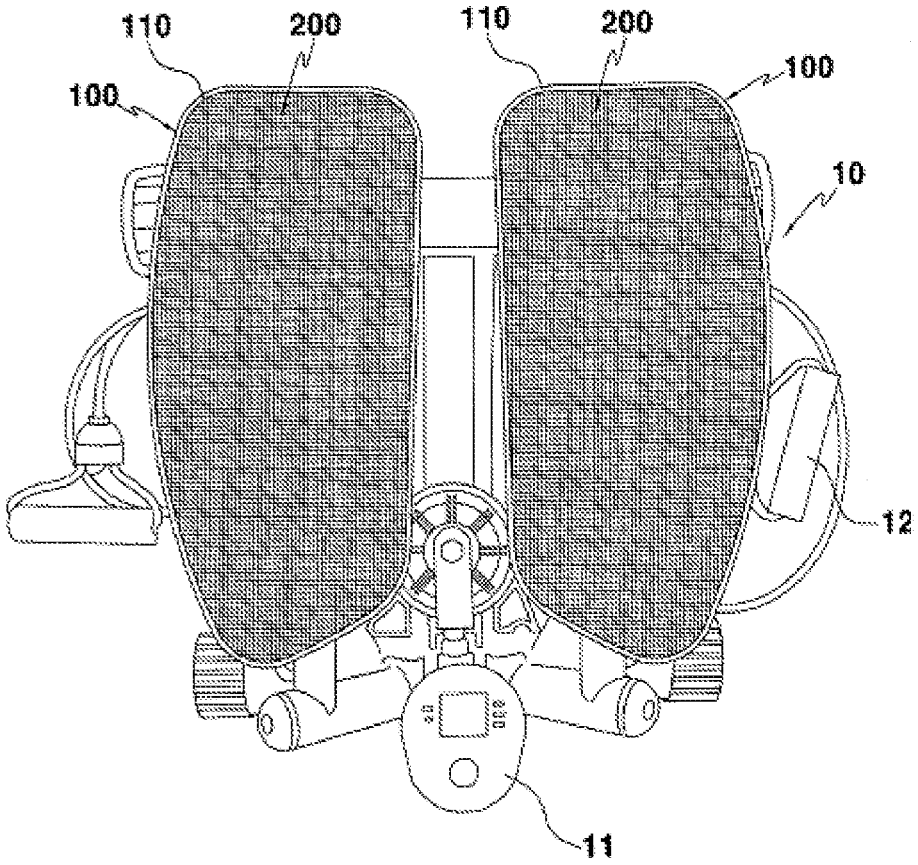
FIG. 7 is the ground plan of the stepper that shows the using state plan of the invention.

These scaffoldings are installed on the both sides of the stepper (10) like FIG. 7. As is generally known, they (100) are made of firm synthetic resins just like PVC, and the soft mats (200) are attached on the upper sides of the scaffoldings (100) in order to get users to step the scaffoldings' mats (200).

These mats (200) are attached by super glue on the scaffoldings, and made of elastic bodies which feel soft, for users to be able to exercise with bare feet not wearing sneakers.

The following is the explanation of the a various of embodiment of the stepper scaffoldings with mats.

This invention's feature is the top edges of the upper stepper (100) embossed on the stepper's scaffoldings by the separating prevention frames (110) which cover the outside of the mats (200). Because the supporting frames (110) form at the top edges of the scaffoldings, the mats (200) are put in the supporting frames (110) of the scaffoldings (100). The edges of the frames (110) prevent the mats (200) from separating at the scaffoldings (100) when the scaffoldings are tilted during exercising.

According to the embodiment of the invention, the mats (200) are made of elastic bodies mixed with rubber and silicon at 5 to 5 ratio. These ingredients make the mats restored after pressurizing slowly. So, users can obtain effects like walking along red clay roads.

Moreover, the mats (200) are restored after pressurizing because the mats (200) are made of the silicon.

A number of bumps (210) form densely at the top of the above mats (200). Because the grooves between a bump (210) and a bump (210) are made deeply, the air elasticity among the bumps (210), such as a cushion, is generated when the feet reach them. This air elasticity makes friction parts soft, and the bumps (210) on the mats give acupressure effects at the bottom of the feet.

Figure 4:
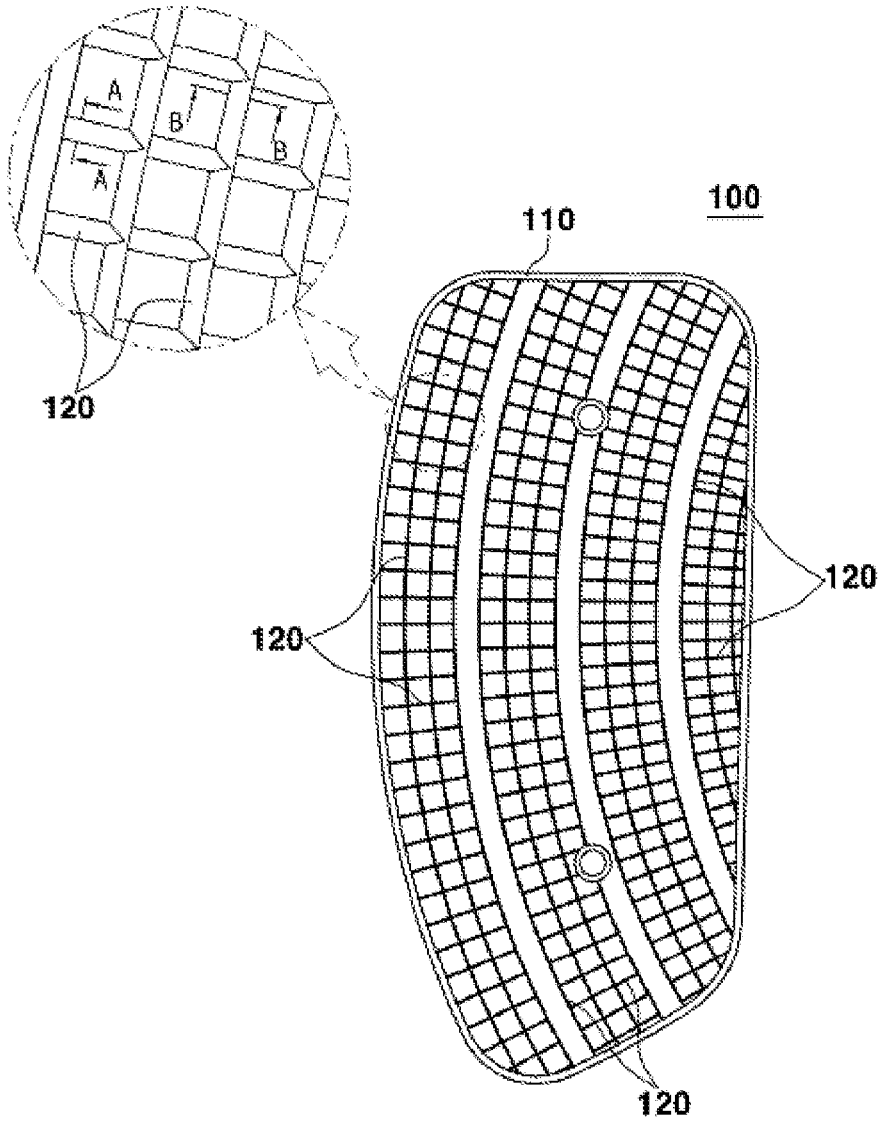
FIG. 4 is the ground plan which shows the protrusions the scaffoldings of the invention.
Figure 5:
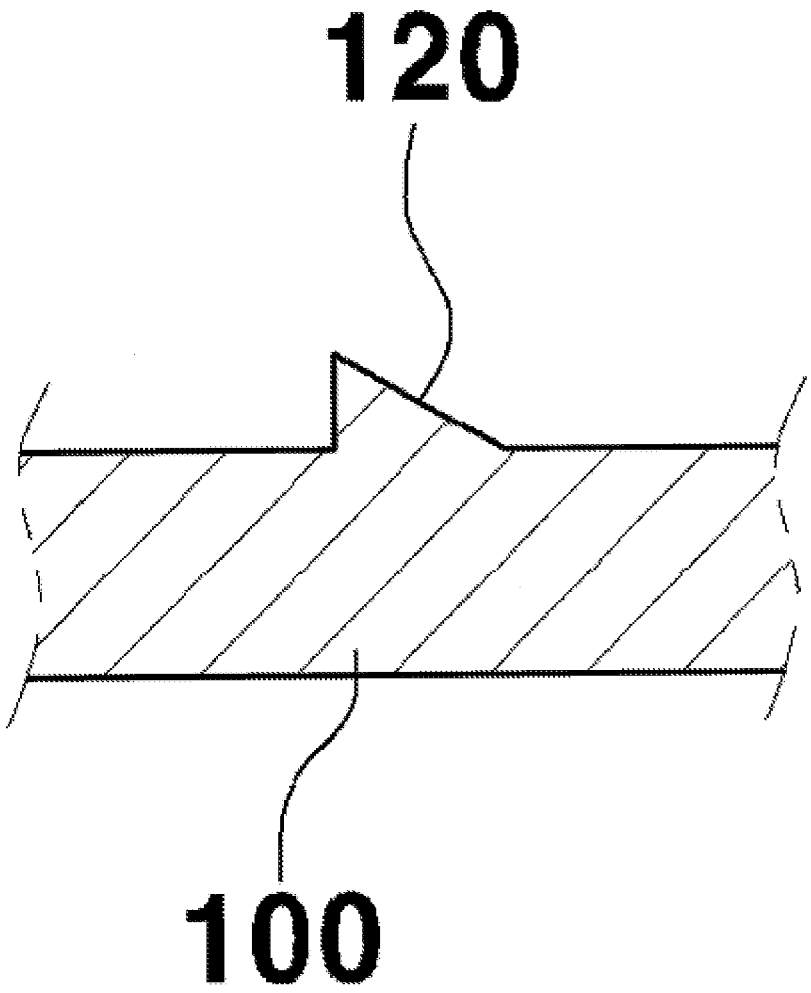
FIG. 5 is the expansion cross-sectional diagram of FIG. 4 A-A.
Figure 6:
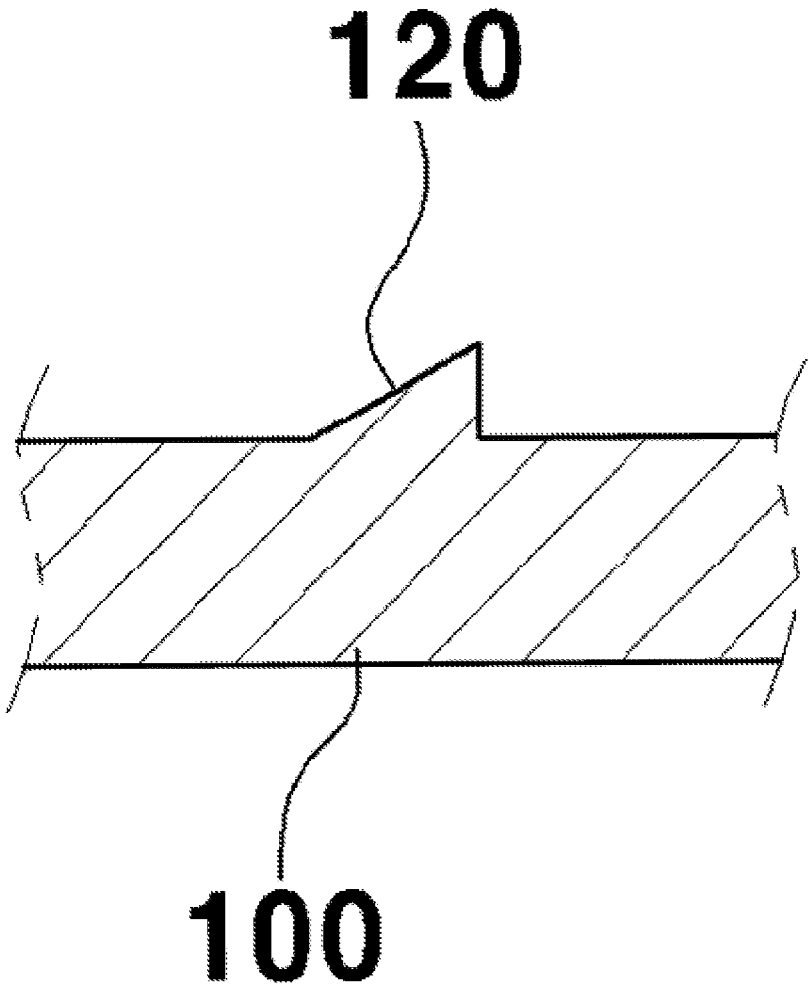
FIG. 6 is the expansion cross-sectional diagram of FIG. 4 B-B.

According to the embodiment of the invention, the upper scaffoldings (100) have many bumps (120) in grid patterns like FIG. 4,5,6. At this moment, each protrusion has a right angle and a tilt angle like FIG. 5 and FIG. 6. Thus these mats (200) of the stepper's scaffoldings (100) form right-angled triangles which are comprised of vertical faces and inclined planes. As the result, these frames prevent the upper mats from separating on the scaffoldings even though the scaffoldings are tilted at an angle of 45 degrees. Also, when the weight of 100 kg is continuously added at the mats (200), the mats (200) are not separated from the scaffoldings (100).

In addition the area of the existing stepper's scaffoldings is 145 mm at the most, but our invention's area is 180 mm. So, the size of the scaffoldings gives users more comfortable exercise area.

Therefore, the invention of the stepper scaffoldings attaching the mats like this has the following merits.

First, because the soft mats (200) are attached on the upper scaffoldings (100), users do not have to put on sneakers, and can comfortably exercise with bare feet stepping the scaffoldings.

Second, when users exercise on the mats (200) of the stepper (10), they can get effects such as walking on the soft red clay roads with bare feet.

Third, exercising with bare feet on the soft mats for a long time does not give the feet fatigue and the brain fatigue. So, users can prevent their joints, waists, and ankles as well as can get the fatigue recovery and the acupressure effects.

Last, when users exercise on the soft scaffoldings, they can recover their fatigue like during swimming.

INDUSTRIAL APPLICABILITY

Modern people mostly spend their daily work at their office every day, therefore they are exposed to all lifestyle diseases such as diabetes, high blood pressure through lack of exercise. So, they sincerely need sporting goods that they can aerobic exercises and strength exercises indoors.

What is claimed is:

1. A scaffold for a fitness stepper, the scaffold comprising:

a scaffolding plate configured to be installed on the fitness stepper; and a mat attached on upper side of the scaffolding plate, wherein, the scaffolding plate comprises, a separating prevention frame extended from edge of the scaffolding plate and surrounding the mat attached on the upper side of the scaffolding plate, and a plurality of protrusions form on the upper side of the scaffolding plate, and the mat comprises, a plurality of bumps formed on an upper side of the mat, and a plurality of grooves between adjacent bumps of the plurality of bumps, and wherein, the plurality of protrusion is arranged to form a grid pattern on the upper side of the scaffolding plate, each protrusion of the plurality of protrusions has a right triangle shape having a right angle and a tilt angle with the upper side of the scaffolding plate, and when the mat is pressurized, the mat is configured to provide air elasticity generated between the plurality of bumps and the plurality of grooves.

2. A fitness stepper comprising:

a structure having oil pressure or air pressure cylinders; and a pair of scaffolds installed on the structure, wherein each scaffold of said pair of scaffolds comprises, a scaffolding plate configured to be installed on the fitness stepper, and a mat attached on upper side of the scaffolding plate, wherein, the scaffolding plate comprises, a separating prevention frame extended from edge of the scaffolding plate and surrounding the mat attached on the upper side of the scaffolding plate, and a plurality of protrusions form on the upper side of the scaffolding plate, and the mat comprises, a plurality of bumps formed on an upper side of the mat, and a plurality of grooves between adjacent bumps of the plurality of bumps, and wherein the plurality of protrusion is arranged to form a grid pattern on the upper side of the scaffolding plate, each protrusion of the plurality of protrusions has a right triangle shape having a right angle and a tilt angle with the upper side of the scaffolding plate, and when the mat is pressurized, the mat is configured to provide air elasticity generated between the plurality of bumps and the plurality of grooves.

* * * * *